US007182587B1

(12) United States Patent
Raney

(10) Patent No.: US 7,182,587 B1
(45) Date of Patent: Feb. 27, 2007

(54) ANGLEHEAD

(76) Inventor: Aaron A. Raney, 2069 Moccasin La., Knoxville, TN (US) 37921

( * ) Notice: Subject to any disclaimer, the term of this patent is extended or adjusted under 35 U.S.C. 154(b) by 401 days.

(21) Appl. No.: 10/838,556

(22) Filed: May 4, 2004

(51) Int. Cl.
*B05C 17/10* (2006.01)

(52) U.S. Cl. ..... 425/87; 425/458; 15/235.7; 15/235.8

(58) Field of Classification Search ..... 425/87, 425/458; 15/235.4, 235.7, 235.8
See application file for complete search history.

(56) References Cited

U.S. PATENT DOCUMENTS

| | | | |
|---|---|---|---|
| 2,824,443 | A | 2/1958 | Ames |
| 3,056,159 | A | 10/1962 | Hoveland |
| 3,932,101 | A | 1/1976 | Johnson et al. |
| 4,032,283 | A | 6/1977 | Johnson et al. |
| 4,116,604 | A | 9/1978 | Johnson et al. |
| 4,451,223 | A | 5/1984 | Mower et al. |
| 4,669,970 | A | 6/1987 | Perry |
| 4,757,572 | A | 7/1988 | Yon |
| 4,767,297 | A | 8/1988 | Mower et al. |
| 5,010,618 | A | 4/1991 | Croft |
| 5,169,449 | A | 12/1992 | Raught |
| 5,240,394 | A | 8/1993 | James |
| 5,263,836 | A | 11/1993 | Tinawong |
| 5,419,693 | A | 5/1995 | MacMillan |
| 5,423,666 | A | 6/1995 | MacMillan |
| 5,440,776 | A | 8/1995 | Kartler |
| 5,993,306 | A | 11/1999 | McCoy et al. |
| 6,155,809 | A | 12/2000 | Edwards et al. |
| 6,240,591 | B1 | 6/2001 | Maxted |
| 6,439,983 | B1 | 8/2002 | McCoy et al. |

FOREIGN PATENT DOCUMENTS

| | | |
|---|---|---|
| GB | 694673 | 7/1953 |

*Primary Examiner*—Yogendra N. Gupta
*Assistant Examiner*—Thu Khanh T. Nguyen
(74) *Attorney, Agent, or Firm*—Luedeka, Neely & Graham PC

(57) ABSTRACT

An improved drywall finishing tool and method for using the tool. The drywall finishing tool includes a rigid body portion having a first section, a second section, and a smoothly curved center section. An inlet port is provided on one side thereof adjacent the center section. There are one or more cavities in the first and second sections. The one or more cavities are in fluid flow communication with the inlet port. First and second smoothing blades are attached on a first end of the first and second sections of the body portion. A removable cap is attached to the center section on a first end thereof. A removable cover is attached to the center section on a second end opposite the first end. The tool is specifically adapted for disposing and smoothing drywall compound between adjacent drywall panels to provide a smoothly curved inside corner between the drywall panels.

18 Claims, 7 Drawing Sheets

ANGLEHEAD

FIELD OF THE INVENTION

The invention relates to construction tools and in particular to improved tools for finishing drywall panels to provide decorative corners.

BACKGROUND OF THE INVENTION

Currently, there exist a variety of tools for finishing drywall panels. For example, inside and outside corner finishing tools have been developed to provide finished 90° inside and outside corners where two drywall panels meet. The earliest tool designed for inside corner finishing was developed in about 1954 by R. G. Ames. (U.S. Pat. No. 2,824,443, issued Feb. 25, 1958). Since that time, numerous modifications to the basic tool have been made. These tools, known as "anglehead" tools apply a thin layer of mastic or drywall compound to the corners to cover a tape that is applied to the corners to hide imperfections and gaps between the drywall panels.

A current trend in home construction is the provision of rounded inside and outside corners. Such decorative features may be provided by molded inserts attached to the drywall panels. Tools for finishing the outside corners have been developed, however, there currently exists a need for an anglehead tool for finishing the inside corners between adjacent drywall panels.

SUMMARY OF THE INVENTION

With regard to the above and other objects and advantages, the invention provides an improved drywall finishing tool and method for using the tool. The drywall finishing tool includes a rigid body portion having a first section, a second section, and a smoothly curved center section joining the first section and second section. An inlet port is provided on one side thereof adjacent the center section. There are one or more cavities on an opposing side thereof in the first and second sections. The one or more cavities are in fluid flow communication with the inlet port. First and second smoothing blades are attached on a first end of the first and second sections of the rigid body portion. A removable cap is attached to the center section on a first end thereof. A removable cover is attached to the center section on a second end thereof opposite the first end. The removable cap and removable cover have substantially smoothly curved contours. The tool is specifically adapted for disposing and smoothing drywall compound between adjacent drywall panels to provide a smoothly curved inside corner between the drywall panels.

In another embodiment, there is provided a method for finishing an inside corner between adjacent drywall panels. The method includes the steps of providing an improved anglehead tool including a substantially rigid body portion having a first section, a second section, and a smoothly curved center section joining the first section and second section. The tool includes an inlet port on one side thereof adjacent the center section. One or more cavities are on an opposing side thereof in the first and second sections. The one or more cavities are in fluid flow communication with the inlet port. First and second smoothing blades are attached on a first end of the first and second sections of the rigid body portion. A removable cap is attached to the center section on a first end thereof. A removable cover is attached to the center section on a second end thereof opposite the first end. The removable cap and removable cover have substantially smoothly curved contours. A drywall finishing compound is supplied to the anglehead tool while drawing the tool from a first end of the inside corner between the drywall panels to second end of the inside corner between the drywall panels. The tool applies sufficient drywall finishing compound on the inside corner between the adjacent drywall panels to provide a smoothly curved inside corner between the adjacent drywall panels.

An advantage of the invention is that it provides a tool suitable for forming smoothly curved inside corners between adjacent wall panels using mastic or other suitable wall finishing compounds to provide a decorative corner between the panels. No special moldings or other inserts are needed for the wall panels to provide the decorative look desired. The tool also enables inside corner finishing to be done quickly using conventional tape and wall finishing compounds.

BRIEF DESCRIPTION OF THE DRAWINGS

Further advantages of the invention will become apparent by reference to the detailed description of preferred embodiments when considered in conjunction with the following drawings illustrating one or more non-limiting aspects of the invention, wherein like reference characters designate like or similar elements throughout the several drawings as follows.

DETAILED DESCRIPTION OF THE INVENTION

Figure 1:
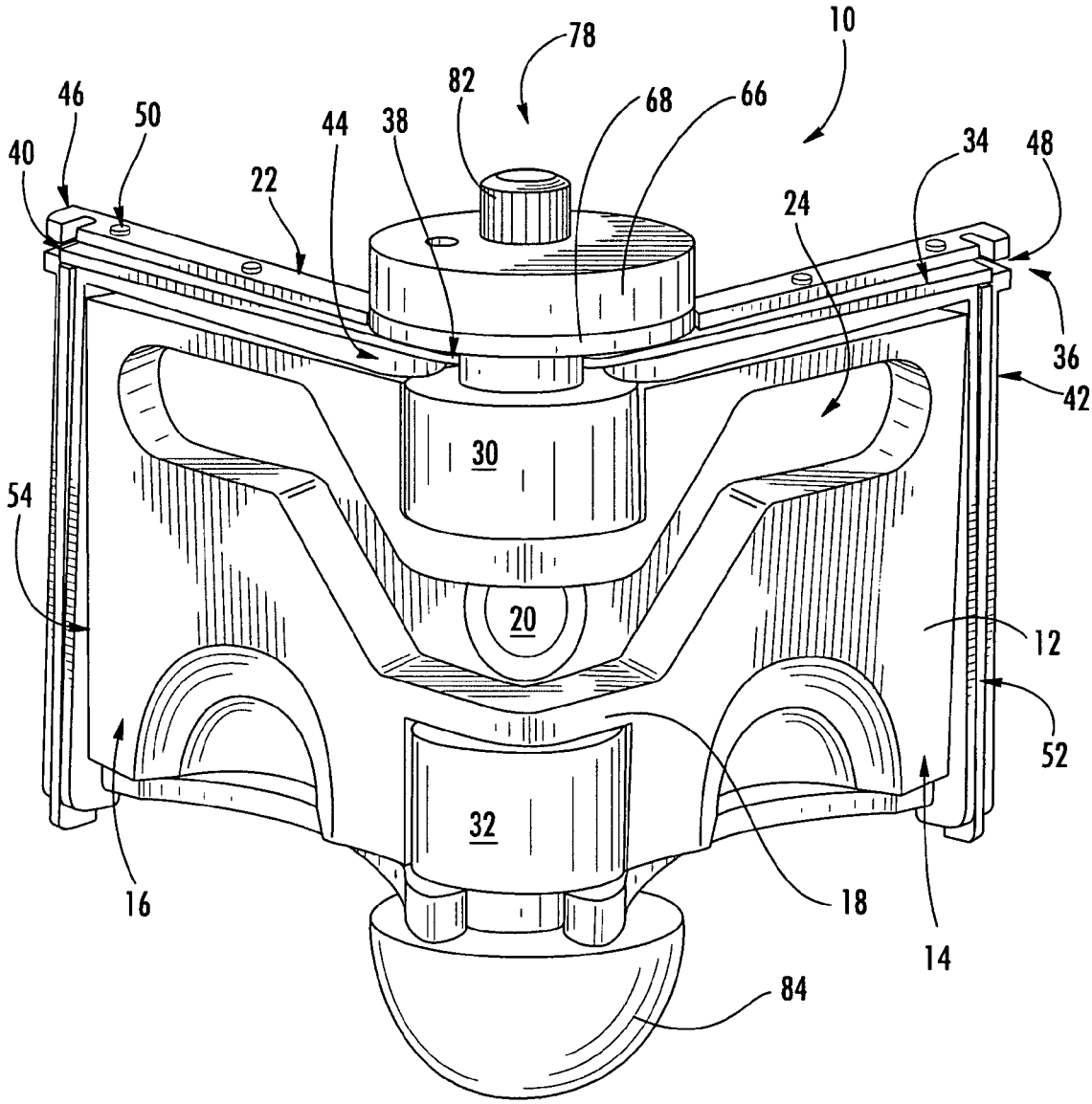
FIG. 1 is a perspective view, not to scale, of an anglehead tool according to the invention.
Figure 2:
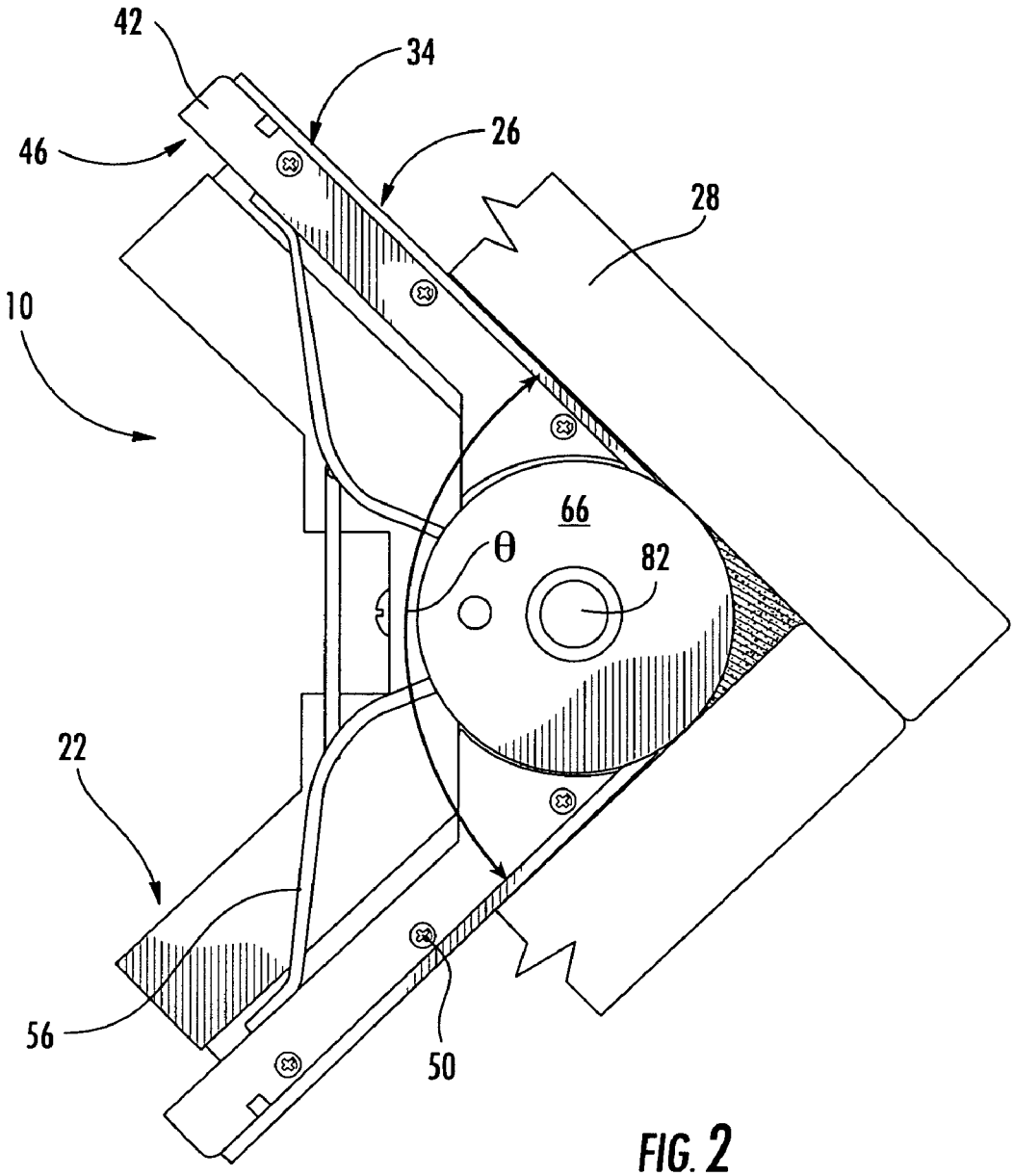
FIG. 2 is a top plan view, not to scale, of an anglehead tool according to the invention.

With reference to FIGS. 1 and 2, the anglehead tool 10 according to the invention includes a substantially rigid body portion 12. The body portion 12 includes a first section 14, a second section 16, and a smoothly curved center section 18 joining the first section 14 and second section 16. An inlet port is provided on a first surface side 22 of the body portion 12 adjacent the center section 18. One or more cavities 24 are provided on a second surface side 26 of the body portion 12, the one or more cavities 24 being in fluid flow communication with the inlet port 20. At least a portion of each of the cavities 24 is preferably disposed in the first and second sections 14 and 16.

It is preferred that the first and second sections 14 and 16 have a second surface side 26 that provides a V-shaped surface as seen in top plan view in FIG. 2, wherein the first and second sections 14 and 16 form an angle θ of from about 45° to about 175°. An angle θ of about 85° to about 90° is particularly preferred for a tool for wall panels 28 disposed at about 90° to one another. While it is preferred that the first and second sections 14 and 16 be fixed in a preferred angular orientation, a tool 10 having angularly rotatable first and second sections 14 and 16 attached to a center section 18 may also be provided. When the tool 10 includes angularly rotatable first and second sections 14 and 16, it is preferred than an angle fixing device be used to prevent substantially movement of the first and second sections 14 and 16 once the desired angle for the first and second sections 14 and 16 is selected.

The one or more cavities 24 in the first and second sections 14 and 16 are in fluid flow communication with the inlet port 20 to provide flow of wall finishing compound to the one or more cavities 24. The inlet port 20 is connected to a supply of wall finishing compound for flow thereto during use of the tool. The wall finishing compound may be provided to the inlet port 20 either continuously or batchwise during use of the tool 10.

The body portion 12, including the center section 18 and first and second sections 14 and 16, may be made of a variety of materials including metals and plastics and may be molded or machined to provide the inlet port 20 and the one or more cavities 24. A particularly preferred material for the body portion 12 is aluminum or other light weight metal. The body portion 12 may be molded as a single piece including the center section 18 and first and second sections 14 and 16, or as shown in FIG. 1, the center section 18 may be composed of removable inserts 30 and 32 having a smoothly curved contour adjacent the second surface side 26 of the tool 10.

Smoothing blades 34 are provided on a first end 36 of the first and second sections 14 and 16 of the rigid body portion 12. The smoothing blades 34 have proximal ends 38 and distal ends 40. The proximal ends 38 of the smoothing blades 34 are adjacent the center section 18 of the body portion 12. The smoothing blades 34 are preferably removably attached to the first and second sections 14 and 16 for cleaning and replacement due to wear or damage. It is preferred that at least the distal ends 40 of the smoothing blades 34 be angularly flexible with respect to the wall panels 28 during use of the tool 10. According the smoothing blades 34 may be provided in a biasing device loaded cavity in the first and second sections 14 and 16, or preferably, blade holders 42 are provided and movably attached to the first and second sections 14 and 16. Like the smoothing blades 34, the blade holders 42 include proximal ends 44 and distal ends 46. The blade holders 42 preferably include slots 48 therein for holding the smoothing blades 34 and blade attachment devices such as set screws 50 to fixedly hold the smoothing blades 34 in the blade holder slots 48.

Each of the blade holders 42 also preferably includes an edge blade 52 disposed at about 90° to the smoothing blades 34, the edge blade being adjacent the distal ends 46 of the blade holders 42. The edge blade 52 provides guiding contact with the wall panels 28 and prevents or reduces the amount of wall finishing compound flowing past an edge 54 of the first and second sections 14 and 16. The edge blades 52 thereby act to contain the wall finishing compound within a confined area adjacent the second surface side 26 of tool 10. Like the smoothing blades 34, the edge blades 52 are also preferably removably attached to the blade holders 42, as by set screws or other suitable holding means.

A biasing device 56 is preferably provided on the first surface side 22 of the body portion 12 adjacent the blade holders 42 to bias at least the distal ends 46 of the blade holders 42 toward the wall panels 28 during use of the tool 10. The biasing device 56 may be provided by a leaf spring or other resilient material for firmly biasing the smoothing blades 34 toward the wall panels 28.

Figure 3:
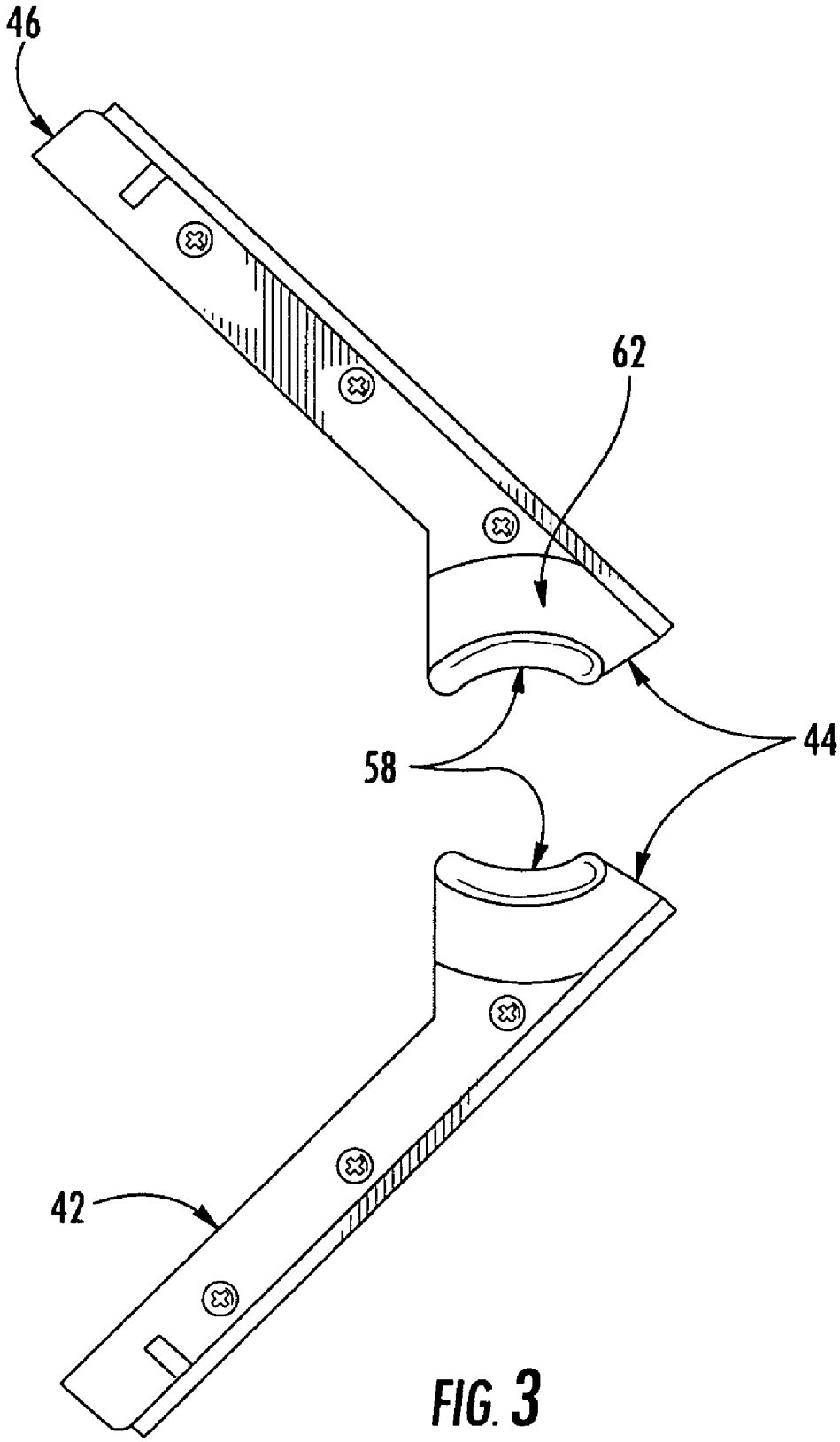
FIG. 3 is a top plan view of blade holders for an anglehead tool according to the invention.
Figure 4:
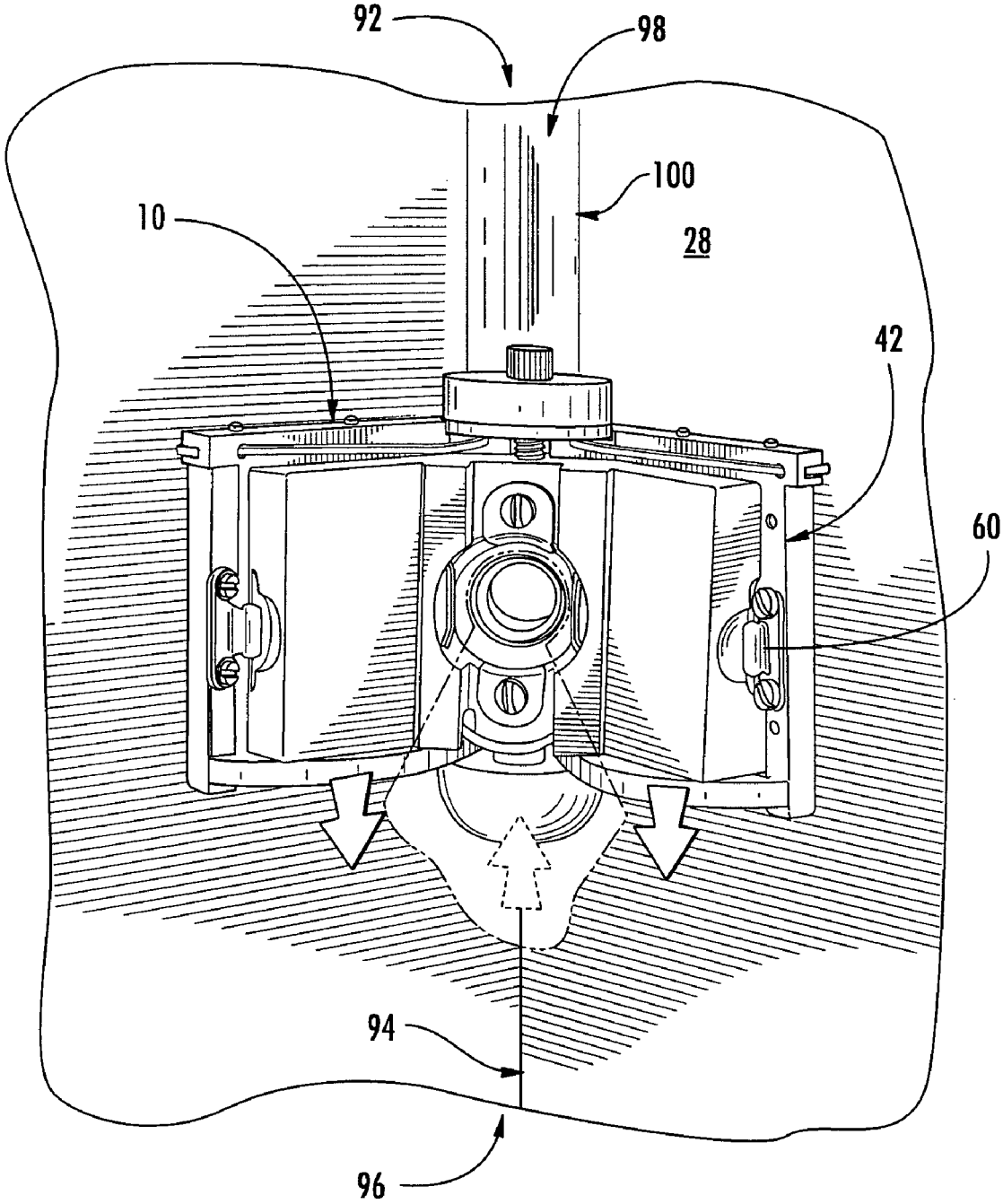
FIG. 4 is a perspective view, not to scale, of an anglehead tool adjacent wall panels during use of the tool.
Figure 5:
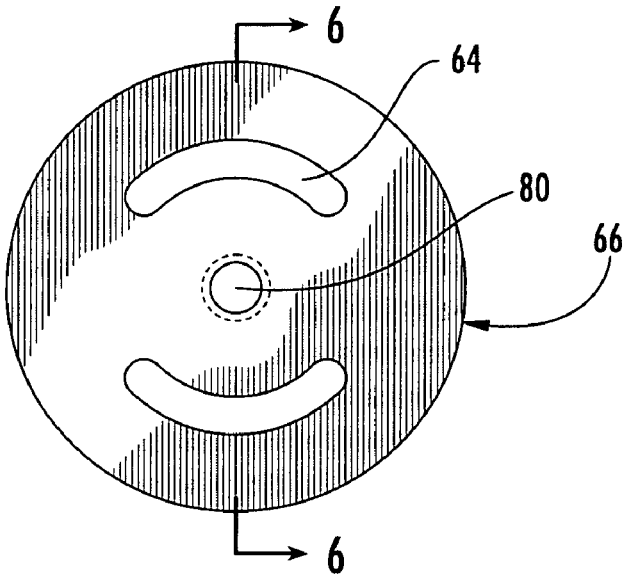
FIG. 5 is a top plan view, not to scale, of a removable cap for an anglehead tool according to the invention.
Figure 6:
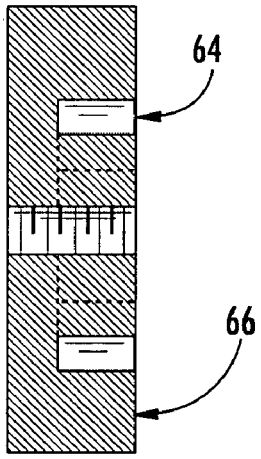
FIG. 6 is a cross-sectional view, not to scale of the cap of FIG. 5.

In order for the blade holders 42 to be biased toward the wall panels 28, each the blade holders 42 preferably includes first retaining bosses 58 (FIG. 3) adjacent the proximal ends 44 thereof and retaining pawls 60 (FIG. 4) on the distal ends 46 thereof. The first retaining bosses 58 are arcuate projections from a first surface 62 of the blade holders 42. Such first retaining bosses 58 cooperatively translate within retaining cavities 64 in a removable cap 66 (FIGS. 5 and 6) described in more detail below. The first retaining bosses 58 and retaining cavities 64 are provided to enable angular flexing of the blade holders 42 to compensate for imperfections in the adjacent wall panels 28 during a smoothing operation using the tool 10. The cooperation between the first retaining bosses 58 and retaining cavities 64, in combination with other features of the tool 10, limits the flow of wall finishing compound to a substantially confined area adjacent the tool 10 during use of the tool 10.

Figure 8:
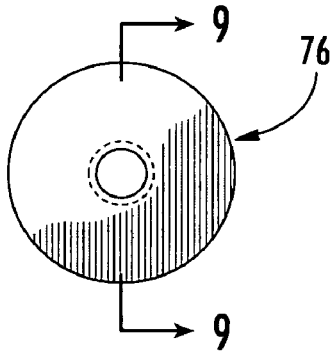
FIG. 8 is a top plan view, not to scale, of a spacer for an anglehead tool according to the invention.
Figure 9:
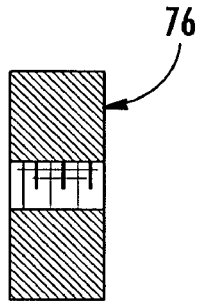
FIG. 9 is a cross-sectional view, not to scale, of the spacer of FIG. 8.
Figure 7:
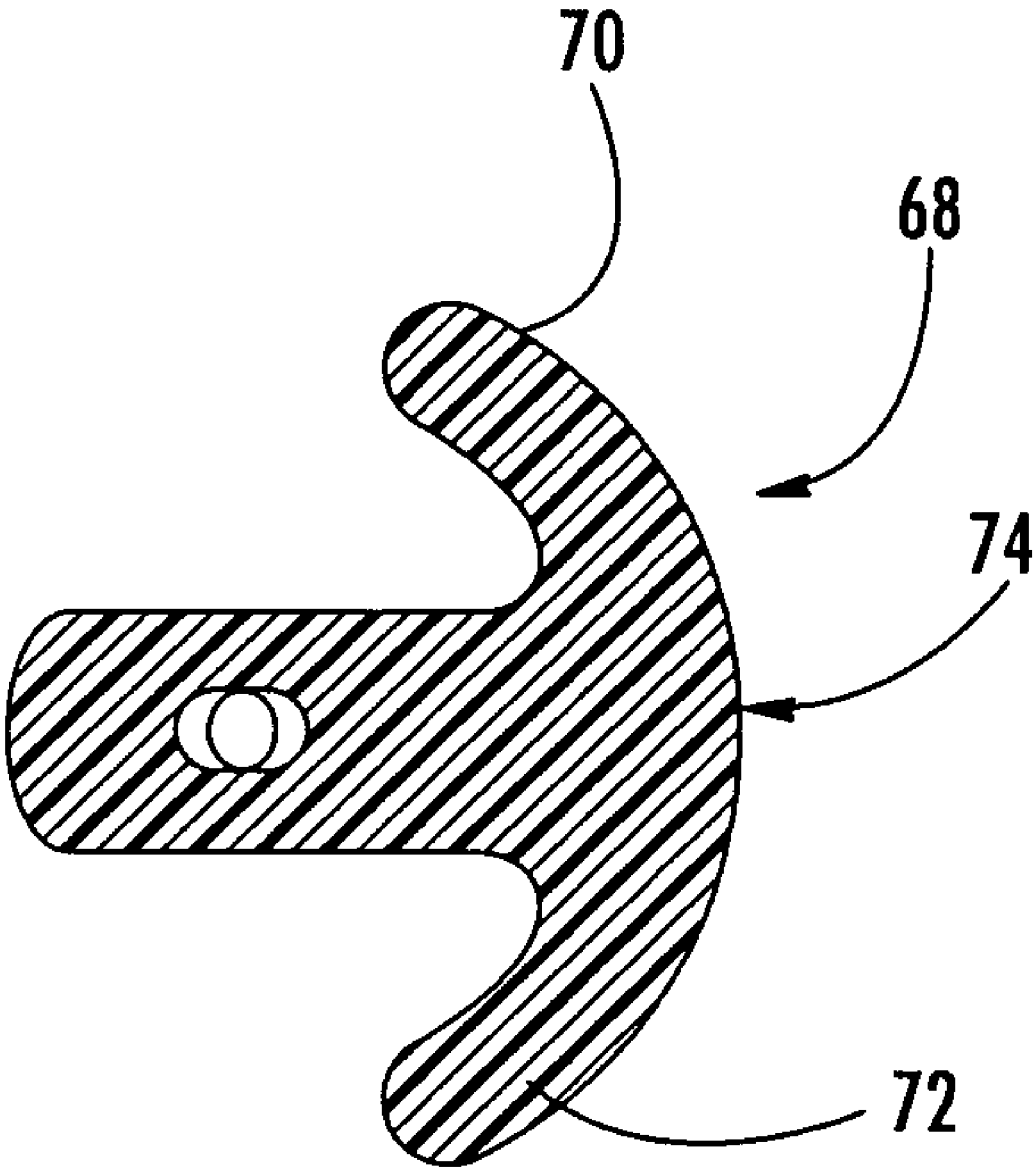
FIG. 7 is a top plan view, not to scale, of a sealing blade for an anglehead tool according to the invention.

A sealing blade 68 (FIG. 7) is preferably provided in order to smooth the wall finishing compound in an area adjacent the center section 18 of the body portion 12. The sealing blade 68 is a substantially T-shaped blade having first and second wing portions 70 and 72 providing an overlapping relationship with the proximal ends 38 of the smoothing blades 34. An edge portion 74 of the sealing blade 68 has a smoothly curved contour as viewed in plan view thereof. The sealing blade 68 is preferably disposed between the removable cap 66 and an elevated portion of the body portion adjacent the center section 12. The elevated portion may be integrally molded with the body portion or may be provided by a separate removable or fixedly attached spacer 76 (FIGS. 8 and 9). The smoothing blades 34, edge blades 52 and sealing blade 68 are preferably made of high carbon steel or other resilient metals or materials that are compatible with the wall finishing compound.

Easy cleaning of the tool and replacement of worn parts, such as smoothing blades 34, edge blades 52 and sealing blade 68, is provided by the provision of the removable cap 66 on at least the first end 78 (FIG. 1) of the body portion 12 adjacent the center section 18. The removable cap 66 contains an aperture 80 therethrough for a retaining screw 82 and the retaining cavities 64 described above for the retaining the bosses 58 on the blade holders 42. It is preferred that the retaining cavities 64 be somewhat larger than the retaining bosses 58 to provide movement of the retaining bosses 58 through a portion of an arc of a circle during use of the tool 10. Accordingly, the retaining cavities 64 have an arc length that is about 20% longer than an arc length of the retaining bosses 58. The retaining cavities 64 may be formed part way through a thickness of the removable cap 66 or may be formed all of the way through the removable cap 66. While a substantially round removable cap 66, as viewed from a top plan view, is preferably provided, any shape removably cap 66 may be used provided it has at least one smoothly curved contour cooperatively positioned with respect to a smoothly curved contour of the center body portion 18 and the edge portion of the sealing blade 74.

Figure 10:
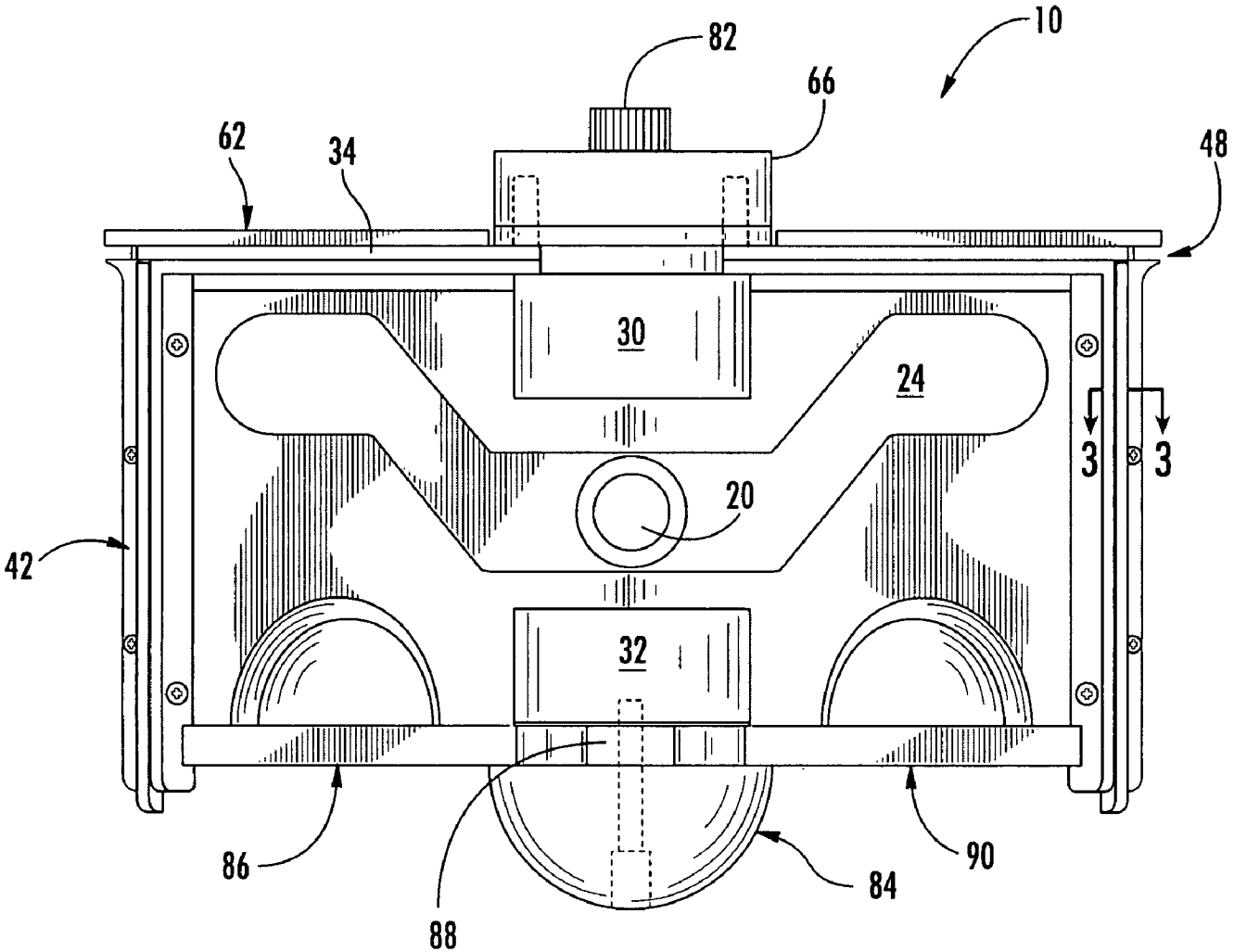
FIG. 10 is an elevational view, not to scale, of an anglehead tool according to the invention viewed from a second surface side thereof.

A removable cover 84 is preferably provided on a second end 86 of the body portion 12 adjacent the center section 18. The removable cover 84 may be substantially identical to the removably cap 66 described above including an aperture and retaining cavities therein, or may be composed of a first spacer section 88 and a removable cover section 84 as shown in FIG. 10. Like the removable cap 66, the removable cover 84 includes a smoothly curved contour on the second surface side 26 of the tool 10. It is particularly preferred that the blade holders 42 include second bosses on a second surface side 90 of the blade holders 42 adjacent proximal ends thereof. As with the first retaining bosses 58 and retaining cavities 64, the second retaining bosses and retaining cavities in the removable cover 84 are provided to enable angular flexing of the blade holders 42 to compensate for imperfections in the adjacent wall panels 28. The removably cover 84 and removable cap 66 may be made of the same material as the body portion 12 or any other resilient material include metals and plastics.

With reference again to FIG. 4, during use of the improved anglehead tool as described herein a wall finishing compound is supplied to the inlet port 20 of the tool 10 either batchwise or continuously as the tool 10 is drawn between adjacent wall panels 28 from a first end 92 of an inside corner 94 between the wall panels 28 to a second end 96 of the inside corner 94 between the wall panels 28. As the tool 10 is drawn from the first end 92 to the second end 96, sufficient drywall finishing compound 98 is applied to the inside corner 94 between the adjacent drywall panels 28 to provide a smoothly curved inside corner 100 as shown. Depending on the angle θ of the anglehead tool 10, a smoothly curved inside corner 100 may be provided between adjacent wall panels 28 disposed at angles ranging from about 75° or less to about 175° relative to one another.

Aspects of the invention were described with respect to drywall finishing, however, the anglehead tool 10 described herein is not limited to drywall finishing or the use of drywall finishing compounds. The anglehead tool 10 is adaptable to applying other compounds to surfaces to provide desired decorative or functional features such as smoothly curved inside corner features.

It is contemplated, and will be apparent to those skilled in the art from the preceding description and the accompanying drawings, that modifications and changes may be made in the embodiments of the invention. Accordingly, it is expressly intended that the foregoing description and the accompanying drawings are illustrative of preferred embodiments only, not limiting thereto, and that the true spirit and scope of the present invention be determined by reference to the appended claims.

What is claimed is:

1. A drywall finishing tool comprising:

a substantially rigid body portion having a first section, a second section, and a smoothly curved center section joining the first section and second section, an inlet port on one side thereof adjacent the center section, and one or more cavities on an opposing side thereof in the first and second sections, the one or more cavities being in fluid flow communication with the inlet port;

first and second smoothing blades attached on a first end of the first and second sections of the rigid body portion;

a removable cap attached to the center section on a first end thereof; and a removable cover attached to the center section on a second end thereof opposite the first end, wherein the removable cap and removable cover have substantially smoothly curved contours, and wherein the tool is specifically adapted for disposing and smoothing drywall compound between adjacent drywall panels to provide a smoothly curved inside corner between the drywall panels.

2. The drywall finishing tool of claim 1, further comprising a sealing blade having a curved edge portion disposed between the removable cap and the body portion.

3. The drywall finishing tool of claim 2, wherein the sealing blade comprises a substantially T-shaped sealing blade.

4. The drywall finishing tool of claim 2, wherein the sealing blade is adjacent the first end of the rigid body portion and is disposed between the removable cap and a spacer attached to the body portion.

5. The drywall finishing tool of claim 1, further comprising first and second blade holders attached to the first and second sections of the body portion, wherein the smoothing blades are removably attached to the first and second blade holders.

6. The drywall finishing tool of claim 5, further comprising a bias device attached to the body portion and blade holders to bias the blade holders toward the drywall panels during a compound applying and finishing operation.

7. The drywall finishing tool of claim 5, wherein each of the first and second blade holders further comprises an edge blade holder for holding a removable blade adjacent a side edge of the first and second sections.

8. The drywall finishing tool of claim 5, wherein each of the first and second blade holders contains a raise arcuate boss on an end adjacent the center section, and wherein the removable cap contains first and second recesses for receiving the arcuate boss of the first and second blade holders.

9. A method for finishing an inside corner between adjacent drywall panels, the method comprising the steps of:

providing an improved anglehead tool including a substantially rigid body portion having a first section, a second section, and a smoothly curved center section joining the first section and second section, an inlet port on one side thereof adjacent the center section, and one or more cavities on an opposing side thereof in the first and second sections, the one or more cavities being in fluid flow communication with the inlet port; first and second smoothing blades attached on a first end of the first and second sections of the rigid body portion; a removable cap attached to the center section on a first end thereof; and a removable cover attached to the center section on a second end thereof opposite the first end, wherein the removable cap and removable cover have substantially smoothly curved contours;

supplying drywall finishing compound to the anglehead tool while drawing the tool from a first end of the inside corner between the drywall panels to second end of the inside corner between the drywall panels; and applying sufficient drywall finishing compound on the inside corner between the adjacent drywall panels using the anglehead tool to provide a smoothly curved inside corner between the adjacent drywall panels.

10. The method of claim 9, wherein the tool includes a sealing blade having a curved edge portion disposed between the removable cap and the body portion.

11. The method of claim 10, wherein the sealing blade comprises a substantially T-shaped sealing blade.

12. The method of claim 10, wherein the sealing blade is adjacent the first end of the rigid body portion and is disposed between the removable cap and a spacer attached to the body portion.

13. The method of claim 10, wherein the tool includes first and second blade holders attached to the first and second sections of the body portion, wherein the smoothing blades are removably attached to the first and second blade holders.

14. The method of claim 13, wherein the tool includes a bias device attached to the body portion and blade holders to bias the blade holders toward the drywall panels during a compound applying and finishing operation.

15. The method of claim 13, wherein each of the first and second blade holders includes an edge blade holder for holding a removable blade adjacent a side edge of the first and second sections.

16. The method of claim 13, wherein each of the first and second blade holders contains a raise arcuate boss on an end adjacent the center section, and wherein the removable cap contains first and second recesses for receiving the arcuate boss of the first and second blade holders.

17. The method of claim 13, wherein each of the first and second blade holders contains a raise arcuate boss on an end adjacent the center section, and wherein the removable cap contains first and second recesses for receiving the arcuate boss of the first and second blade holders.

18. The method of claim 13, wherein the drywall panels are disposed to provide an inside corner having about a 90° angle.

* * * * *